US005634315A

United States Patent [19]

Toya

[11] Patent Number: 5,634,315

[45] Date of Patent: Jun. 3, 1997

[54] BUILDINGS METHOD OF CONSTRUCTION

[75] Inventor: Kiyomi Toya, Nagano, Japan

[73] Assignee: Sogo Corporation, Nagano, Japan

[21] Appl. No.: 393,398

[22] Filed: Feb. 23, 1995

[30] Foreign Application Priority Data

Mar. 2, 1994 [JP] Japan ..... 6-058234
Mar. 4, 1994 [JP] Japan ..... 6-060301

[51] Int. Cl.[6] ..... E04B 1/00

[52] U.S. Cl. ..... 52/741.1; 52/299

[58] Field of Search ..... 52/270, 292, 299, 52/741.1, 745.05

[56] References Cited

U.S. PATENT DOCUMENTS

| | | | |
|---|---|---|---|
| 2,396,828 | 3/1946 | Carpenter | 52/270 |
| 3,355,852 | 12/1967 | Lally | 52/270 |
| 3,540,175 | 11/1970 | Hawn | 52/299 |
| 3,662,507 | 5/1972 | Espelano | 52/270 |
| 3,949,532 | 4/1976 | Jonsson et al. | 52/270 X |
| 4,198,797 | 4/1980 | Soble | 52/299 |
| 4,229,919 | 10/1980 | Hughes | 52/299 X |
| 4,615,155 | 10/1986 | Chamberlain | 52/270 X |
| 5,228,249 | 7/1993 | Campbell | 52/270 X |
| 5,311,712 | 5/1994 | Accousti | 52/270 X |
| 5,402,614 | 4/1995 | Jewell | 52/299 |

FOREIGN PATENT DOCUMENTS

| | | |
|---|---|---|
| 4-222735 | 8/1992 | Japan . |
| 4-285242 | 10/1992 | Japan . |
| 4-309636 | 11/1992 | Japan . |

*Primary Examiner*—Carl D. Friedman
*Assistant Examiner*—Beth Aubrey
*Attorney, Agent, or Firm*—Birch, Stewart, Kolasch & Birch, LLP

[57] ABSTRACT

In the construction of a building, for example a house A, a plurality of composite assemblies, such as Pa . . . , are built of pairs of composite boards 2*a* and 3*a* . . . of prescribed thickness held apart by spacers 4*a* . . . of a prescribed width at a fixed spacing. The composite assemblies only are used to make up a wall W . . . and a ceiling C for separating upper and lower floors.

Before the building of the house A begins, a flat foundation plane 24 is built of concrete over the ground E of the house A. A plurality of upright supports 21 . . . have anchor plates 21*c* . . . at the bottom thereof. The anchor plates 21*c* are secured to the foundation plane 24. The upright supports 21 . . . also include retainers 21*j* at the top thereof that are secured to a ground sill 23 as an outermost member of the house A. A cladding panel 22 is installed on the side of the retainer 21*j* to cover up the gap between the ground sill 23 and the foundation plane 24.

This reduces the amount of skilled site work to a minimum, thereby giving significant savings in the time and cost of building as well as in the material cost and improving heat insulation and sound insulation.

9 Claims, 8 Drawing Sheets

BUILDINGS METHOD OF CONSTRUCTION

BACKGROUND OF THE INVENTION

1. Field of the Invention

This invention relates to a building method for the construction of a house or the like.

2. Description of the Relevant Art

In building methods for construction of a house and the like, conventional building methods and prefabricated building methods are well known.

An example of the conventional building methods can be found in Japanese Patent Application Laid-Open No. HEI-4-222735/1992. The building method referred to is a traditional timber-frame building method wherein the building elements such as columns and beams are assembled directly at the building site and then used to assemble and erect walls and ceilings, etc. By contrast, the prefabricated building method involves the mass-production of house building elements in a factory and then moving them to the site for assembly. This building method generally comprises panel system and frame work systems. An example of the panel system is found in Japanese Patent Application Laid-Open No. HEI-4-309636/1992. The panel system involves erecting prefabricated panels at the building site to form walls and ceilings, etc. By contrast, an example of the frame work system is found in Japanese Patent Application Laid-Open No. HEI-4-285242/1992. The frame work system involves prefabricating the house building elements, such as columns and beams, made up of structural steel, for assembly at the site. Prefabricated panels are then installed in place.

The existing building methods described above, however, have the following problems. First, the conventional building methods involve a wide variety of rectangular timbers and boards, etc, which are then assembled at the site by carpenters. The amount of skilled site work is therefore increased, thereby increasing the cost and time of building. A high standard for heat insulation and sound insulation is also difficult to achieve. Second, the panel system as one of the prefabricated building methods involves preparing panels in a factory for assembly at the site, giving the benefit of mass-production. However, this system involves preparing a wide variety of panels, such as studs, boards, and heat insulating boards, so that its total material cost, and heat and sound insulation remain nearly equal to those of the conventional method. Such panels are also difficult to handle and therefore expensive to transport. Third, as another of the prefabricated building methods, the frame work system involves the site assembly and erection of the house building elements, such as columns and beams. This building method is therefore nearly equal to the conventional method with respect to the time and cost of installing the building elements as well as sound insulation and heat insulation.

Further, continuous footings for carrying the substructure of the building is disclosed in the above-mentioned Japanese Patent Application Laid-Open No. HEI-4-309636/1992. The footing is cast in the ground by filling a trench with concrete immediately after it is dug.

This footing has a problem as follows. First, it requires a number of laborious operations such as trenching, backfilling, and erection and stripping of concrete framework. The time and cost of building is therefore increased. Second, since the erection of the framework needs skilled craftsmen and thus involves fully qualified workers, this may often be difficult because of the lack of skilled workers as well as the inconsistent quality of work. Further, the completed continuous footings are difficult to alter and may not accommodate changes to the height of the footing or the location of ventilation holes once the footing is built.

SUMMARY OF THE INVENTION

Accordingly, it is an object of this invention to provide a method for building a building that can be built quickly and easily, thereby giving significant savings in the time and cost of construction including the material cost.

It is another object of this invention to provide a method for building a building which will improve heat insulation and sound insulation.

It is still another object of this invention to provide a method for constructing a building in which the continuous footing can be built easily, thereby reducing the amount of skilled site work and therefore overcoming the lack of craftsmen. This improves the quality and uniformity of the footings. The footing design allows for changes to the footing height and the location of its ventilation holes even after the footing is completed.

In accordance with these objects, for an example where a house A is to be built, this invention has the features as follows. Pairs of composite boards, each of a prescribed thickness, are brought to the site and designated as 2*a* and 3*a*, 2*b* and 3*b*, 2*c* and 3*c* . . . 2*m* and 3*m*. Spacers of fixed width and designated as 4*a* . . . , 4*b* . . . , 4*c* . . . , 5*m* . . . are installed between the composite boards. Thus, composite assemblies, designated as Pa . . . Qm . . . , are built with pairs of the composite boards, designated as 2*a* and 3*a* . . . , 2*m* and 3*m* that are held apart at a fixed spacing. The composite assemblies Pa . . . , Qm . . . only are used to make up walls W . . . and/or ceilings C for separating upper and an lower stories.

In this case the composite boards 2*a* . . . , 3*a* . . . can be lumber core plywood B, or chipboards made by bonding wood chip with adhesives, each of about 20~40 mm in thickness. Spacers 4*a* . . . , 4*b* . . . , 4*c* . . . for use in the walls W, are made of rectangular bars of square cross-section. Spacers 5*m* . . . for use in the ceiling C, are made of strips of composite boards cut into a fixed width and then assembled to form a lattice structure.

Before the house building begins, a flat foundation plane 24 made of concrete is constructed on the ground E where the house A is to be built. A plurality of upright supports 21 . . . have anchor plates 21*c* . . . at their lower ends that are fixed to the foundation plane 24. The supports 21 . . . also include retainers 21*j* at the upper ends that are secured to a ground sill 23 as an outermost member of the house A. A cladding plate 22 is then attached to the side of the supports 21 to cover up the gap between the ground sill 23 and the foundation plane 24, thus providing a continuous footing 20. In this case, the supports 21 are made to allow expansion and contraction between their upper members 21*x* and lower members 21*y*. After the height of the supports 21 is adjusted as desired, the upper members 21*x* and lower members 21*y* are secured together by welding, etc. The cladding plate 22 is a precast concrete panel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

The preferred embodiment of this invention will be described in detail in conjunction with the drawings.

Figure 1:
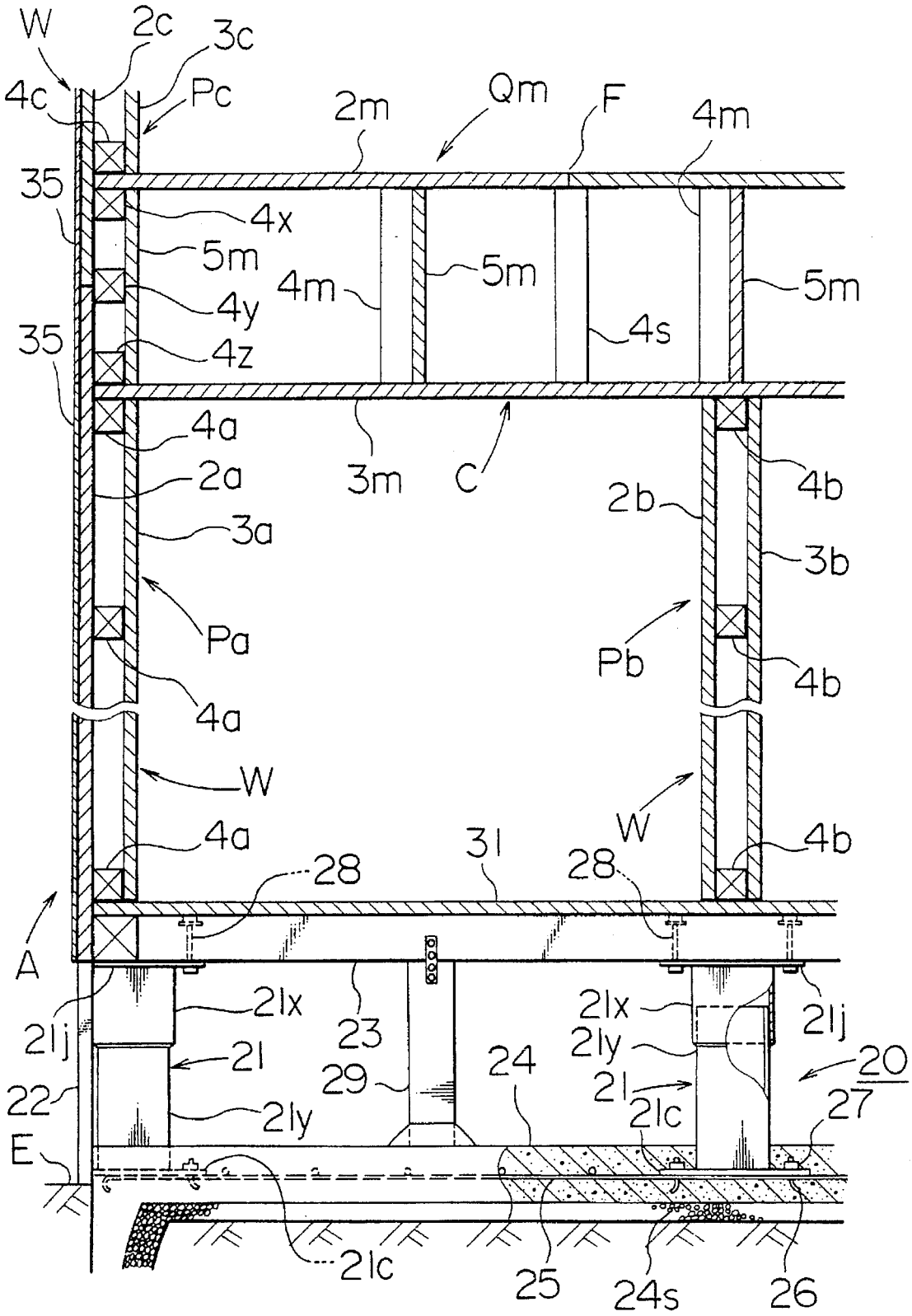
FIG. 1 is a cross-sectional view of a construction built by the building method of the invention.

As the building elements of the house A (construction) of the preferred embodiment, composite boards of prescribed thickness as well as spacers 4*a*, 4*b*, 4*c* . . . 5*m* of a fixed width are brought to the site as shown in FIG. 1.

Figure 5:
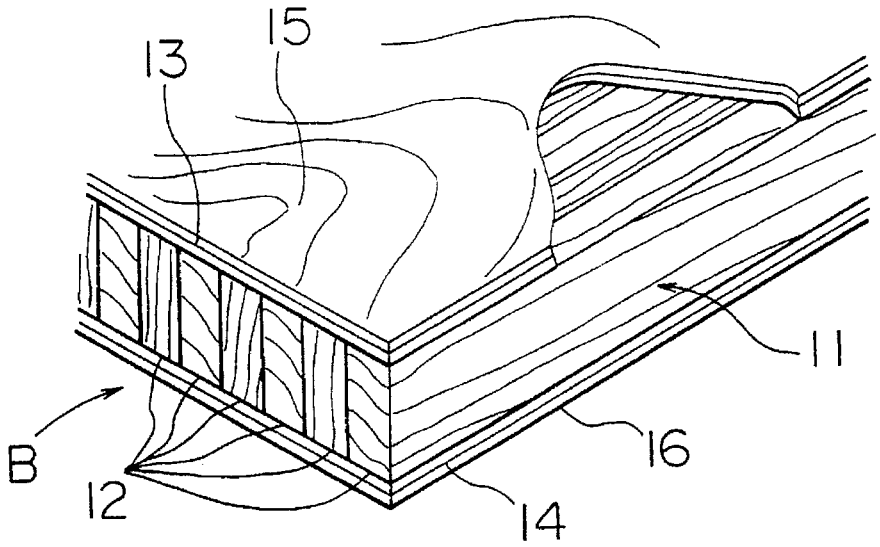
FIG. 5 is a perspective view, with parts broken away, of the lumber core plywood, for use in the construction.
Figure 6:
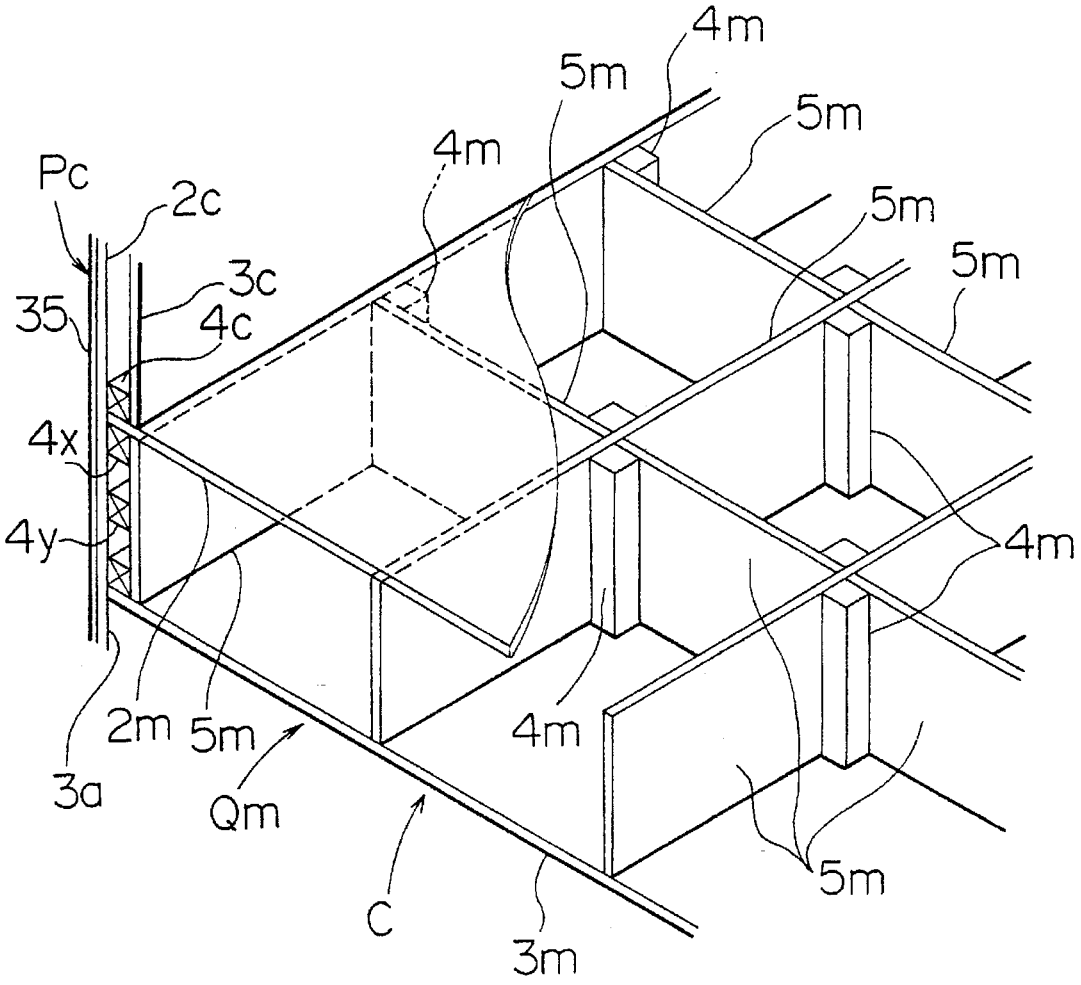
FIG. 6 is a perspective view, with parts broken away, of the ceiling for separating the upper and lower stories of the construction.
Figure 7:
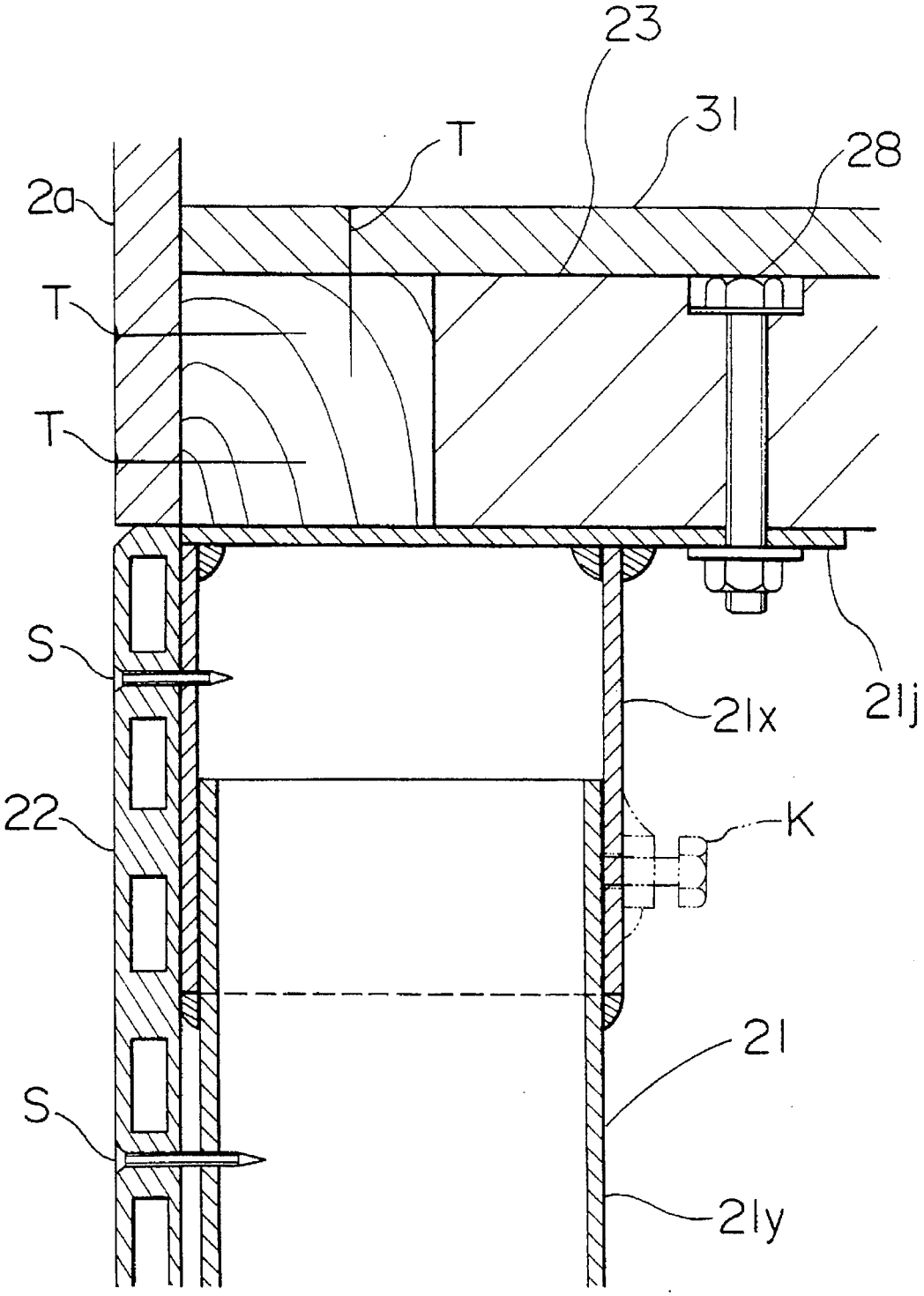
FIG. 7 is an enlarged cross-sectional view showing a part of the continuous footing used in the construction.
Figure 8:
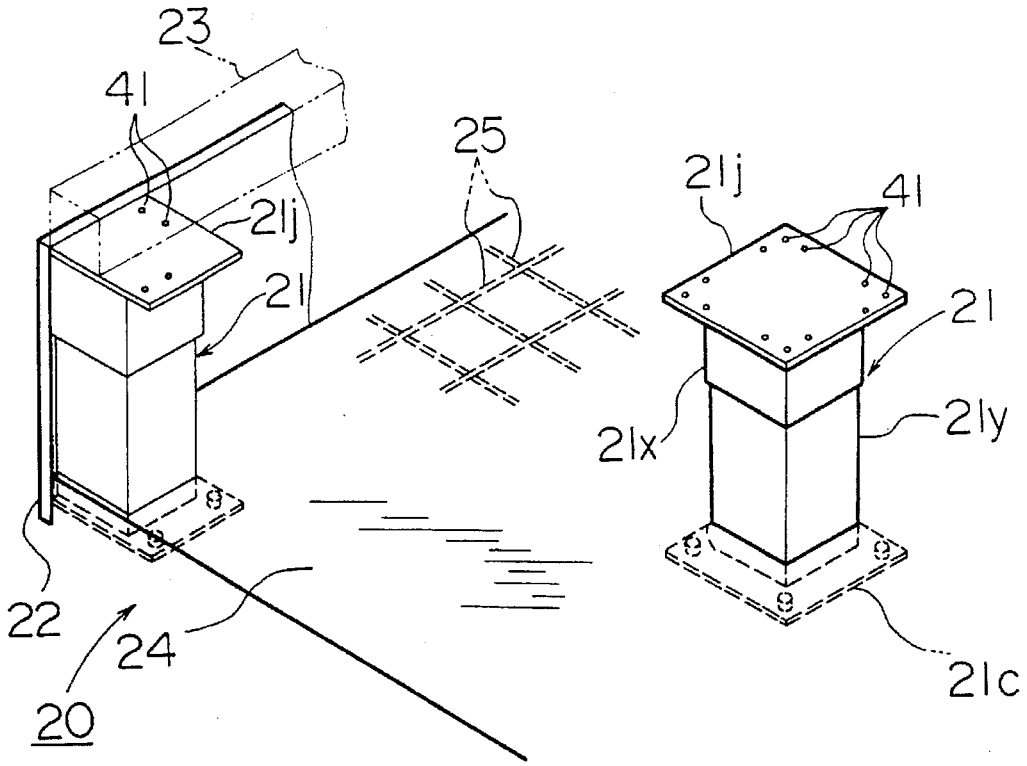
FIG. 8 is a perspective view of the continuous footing.
Figure 9:
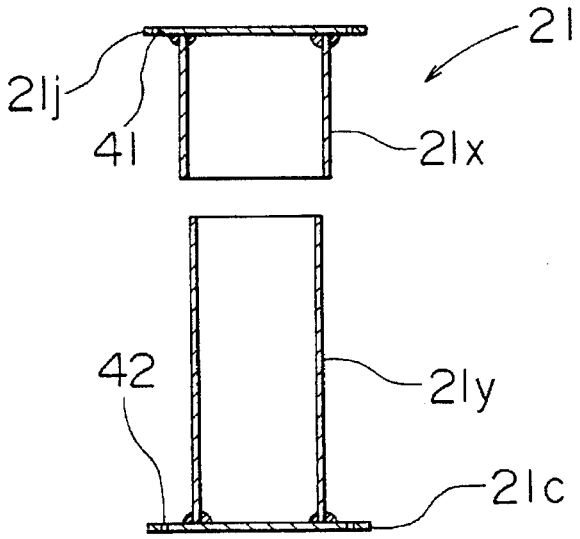
FIG. 9 is a sectional front view showing the upper and lower members of the column, for use in the construction.

The composite boards are about 20~40 mm thick, or preferably 30 mm thick lumber core plywood B, as shown in FIG. 5. The lumber core plywood B are composed of wooden rectangular bars 12 bonded together to form a lumber core 11. The lumber core 11 is covered with two outer layers of cross-bands 13, 14 at its outer faces. The covered core 11 is then sandwiched between a front layer 15 and back layer 16 of veneer. The plywood is excellent in strength and wood conservation.

The spacers 4*a* . . . are rectangular bars of square cross-section with each side 6 cm wide. The spacers 5*m* . . . are strips of lumber core plywood B cut to a prescribed width.

Referring to FIGS. 1 to 10, the building method of the preferred embodiment will be described.

Turning first to FIG. 1, and FIGS. 7 to 10, a continuous footing 20 is constructed. Before constructing the continuous footing 20, a plurality of supports 21 . . . and a plurality of cladding plates (precast concrete panels) 22 . . . are brought to the site.

Each of the supports 21 has an upper member 21*x* and a lower member 21*y*. The upper member 21*x* is made of a rectangular steel pipe with square cross-section. The upper member 21*x* has a retainer 21*j* integrally located at its top for securing to a ground sill 23 of the house A. The lower member 21*y* is made of a rectangular steel pipe with square cross-section, like the upper member 21*x*. In this case, the lower member 21*y* is made to have smaller cross-section than the upper member 21*x*, so that the lower member 21*y* can be inserted into the upper member 21*x*, thereby allowing the entire support 21 to expand and contract. Also, the lower member 21*y* has an anchor plate 21*c* located at its bottom end that is secured to a foundation plane 24 as hereinafter described integrally.

The cladding plate 22 is of a flat rectangular form with a prescribed width and resembles a conventional continuous footing in appearance. The cladding plate 22 may have ventilation holes 22*c* . . . (see FIG. 10) where needed.

In the construction of the continuous footing 20, the ground E where the house A is to be built is excavated or filled to provide a level surface. Over the surface of a completed excavation is placed gravel 24*s*, which is covered with steel reinforcement 25 . . . Concrete is then placed so as to provide a flat foundation plane 24. The anchor plate 21*c* . . . of individual supports 21 . . . is then fixed onto the foundation plane 24 where needed. To secure the anchor plate 21*c* . . . onto the foundation plane 24, before pouring the concrete, the anchor plate 21*c* . . . may be directly connected to the steel reinforcement 25 . . . Alternatively, the anchor bolt 26. . . may be secured by welding, etc, to the steel reinforcement 25 . . . The anchor plate 21*c* . . . is then secured to the steel reinforcement 25 . . . by the anchor bolt 26 . . . and a nut 27 . . . inserted into a bolt hole 42 . . . of the anchor plate 21*c*. If the steel reinforcement 25 . . . is not used, concrete is poured in two stages. A first section of concrete is poured and the anchor bolt 26 . . . is buried in the concrete. The anchor plate 21*c* . . . is then secured into the concrete by the anchor bolt 26 . . . and nut 27 . . . inserted into the bolt hole of the anchor plate 21*c* . . . A second section of concrete is then poured.

Each support 21 . . . is then adjusted to achieve a desired height by sliding the upper member 21*x* . . . relative to the lower member 21*y* . . . At the same time, the upper member 21*x* . . . and the lower member 21*y* . . . are temporarily held together by fitting-up bolts K before finally joining them by welding, etc.

The ground sill 23 of the house A is connected to the retainer 21*j* of the support 21 . . . Connection is made by the ground sill 23 to the retainer 21*j* by bolts and nuts 28 inserted into bolt holes 41 . . . of the retainer 21*j*. If needed, in addition to the supports 21 . . . , intermediate supports 29 may be installed between the ground sill 23 and the foundation plane 24 so as to hold down the ground sill 23.

The cladding plate 22 is attached to the side of the support 21 . . . by screws S and the like so as to cover up the gap between the ground sill 23 at the border of the house A and the foundation plane 24.

The continuous footing 20, as stated above, eliminates the laborious site work, such as trenching and backfilling in the ground E as well as the erection and stripping of the concrete framework. This reduces the time and cost of building and eliminates the need for skilled craftsmen, thereby overcoming the shortage of skilled workers and improving the quality and uniformity of the building. The continuous footing 20 is easy to adjust in height and may be made to resemble the conventional continuous footing in appearance. It is easy to change the location of the ventilation holes 22*c* of the cladding plate 22.

The building of the house A may now proceed as follows. The composite boards 2*a* . . . , 3*a* . . . , 2*m* . . . , 3*m* . . . , shown in the drawings, are the lumber core plywood B, as stated above, cut to prescribed sizes. The composite boards 2*a* . . . , 3*a* . . . , 2*m* . . . , 3*m* . . . as well as the spacers 4*a* . . .

5m . . . are secured together by nails (or wood screws) T . . . , etc., and glued by adhesive where needed. A floor board 31 is secured onto the ground sill 23 by nails or wood screws. The floor board 31 may be a lumber core plywood B.

Figure 2:
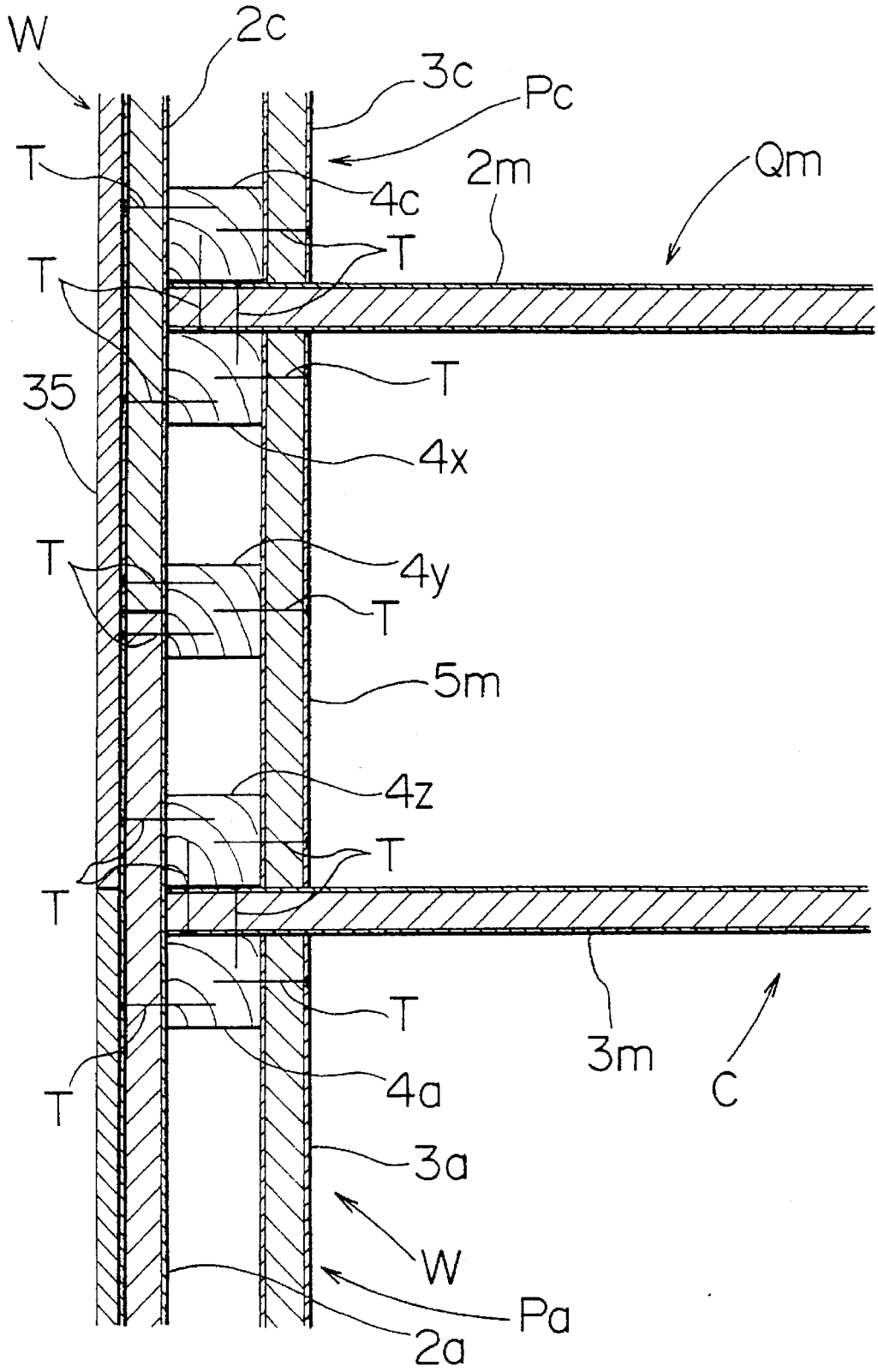
FIG. 2 is a sectional front view showing a part of the construction.

The composite board 2a is secured to the outside of the ground sill 23 by nails or wood screws. A plurality of spacers 4a . . . are then secured onto the inner face of the composite board 2a at least at both end. The composite board 3a is then secured to the spacers 4a . . . In this way a pair of the composite boards 2a and 3a are held apart across the prescribed spacing by the spacers 4a . . . , thus providing a composite assembly Pa with a pair of composite boards 2a and 3a held at the fixed spacing so as to form a wall (external wall) W. In this case, as shown in FIGS. 1 and 2, the composite board 2a lying at the outermost side of the house A may extend upwardly beyond the inner board 3a.

Turning now to the interior of the house A, a spacer 4b is secured onto the floor board 31. A pair of composite boards 2b and 3b are also secured onto the floor board 31, in such a manner that they are held apart by the spacer 4b across the gap. Between the pair of composite boards 2b and 3b, a row of spacers 4b . . . are installed where needed including at least at the top and bottom of the boards 2b and 3b. This provides a composite assembly Pb with a pair of composite boards 2b and 3b held apart at a prescribed spacing so as to form a wall (inner wall) W.

The spacers 4a . . . and 4b . . . once installed serve as gap restraint members and connectors between pairs of composite boards 2a and 3a, and 2b and 3b. Pairs of composite boards 2a and 3a as well as 2b and 3b . . . serve as wall and column members. This provides enhanced strength and heat insulation (sound insulation), etc.

Figure 3:
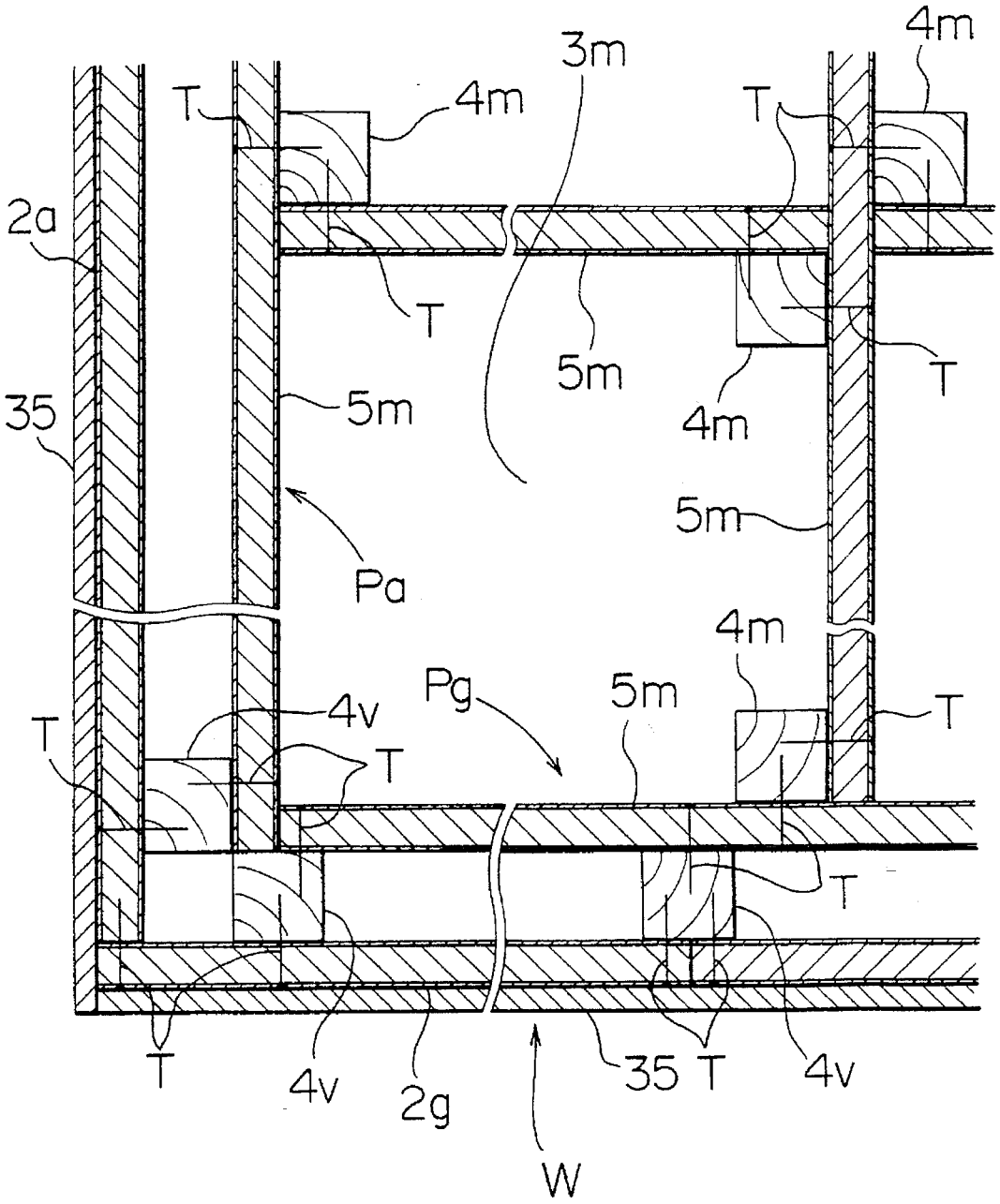
FIG. 3 is a sectional plan view showing a part of the construction.

While FIG. 3 is a sectional front view of the wall W, a plurality of walls W . . . running in different directions, i.e., composite assemblies Pa and Pg . . . are interconnected by joint 4v . . . , which are made of the same material as the spacers 4a. Joint 4v . . . is installed vertically between composite boards 2a . . . and 3a . . . , spacers 4a . . . and 5m . . . , and composite boards 2m and 3m.

A ceiling C for separating a lower floor and an upper floor is constructed on top of the wall W. A composite board 3m is placed and secured onto the top of the wall W. Spacers 5m . . . are secured onto the wall W. The spacers 5m . . . are strips of lumber core plywood B cut to a prescribed width, and are installed to form a lattice structure. In this case the spacers 5m . . . are interconnected by connectors 4m . . . , which are made of the same material as the spacers 4a. A composite board 2m is then placed and secured onto the spacers 5m . . . Thus a composite assembly Qm . . . is installed with a pair of composite boards 2m and 3m held apart at a prescribed spacing, so as to form a ceiling C for separating upper and lower floors.

A joint F between the composite boards 2m in the upper row as shown in FIG. 1 (or the composite board 3m in the lower row) is staggered with respect to the one between the composite boards 3m in the lower row. The joints F between the composite boards 2m and between the composite boards 3m are supported by studs 4s, which are made of the same material as the spacer 4a. The ceiling C is thus provided with strength and heat insulation (sound insulation) equivalent to the walls W . . . The composite boards 2m serves as a floor board of an upper floor (second floor).

Thus, by eliminating the need for the conventional building elements such as columns and beams, and by joining the composite assemblies Pa . . . and Qm . . . only, the complete wall W . . . and ceiling C for separating upper and lower stories is installed in place so as to provide a first floor of the house. In this case the composite boards 2a . . . , 3a . . . , 2m . . . , 3m . . . as well as the spacers 4a . . . , 5m . . . are cut to various shapes before being transported to the site. Using nails T . . . (or wood screws) at the site, workers other than carpenters can easily construct the walls W . . . , the ceiling C for separating upper and lower floors, as well as floors and a part of the roof as hereinafter described. Skilled site work is reduced to a minimum so as to give significant savings in the time and cost of building.

The building of a second floor proceeds in a similar fashion with respect to the first floor described above. In this case the composite boards 2m may be regarded as similar to the floor board 31 of the first floor. A joint 4x is secured to the composite boards 2m at the edge of its underside. The joint 4x is made of the same material as the spacer 4a. Thus the joint 4x serves the same function as the ground sill 23. A composite board 2c is secured to the outside of the joint 4x. A plurality of spacers 4c . . . are secured to the inner face of the composite board 2c at least at both ends. The spacers 4c . . . are then secured to a composite board 3c so as to provide a composite assembly Pc wherein a pair of composite boards 2c and 3c are held apart by the spacers 4c. The composite assembly Pc forms a wall W of the second floor. In this case as shown in FIGS. 1 and 2, the composite board 2c lying at the outermost of the house A is made to extend downward beyond the opposing composite board 3c. The composite board 2c abuts with the top edge of the composite board 2c of the first floor. A joint between the composite boards 2a and 2c at its inner face is supported by a retainer 4y. A spacer 4z is secured below the joint. Other elements of the second floor may be built in a similar fashion with respect to the first floor. When a 3-floor house is to be built, a third floor may be built in like manner.

Figure 4:
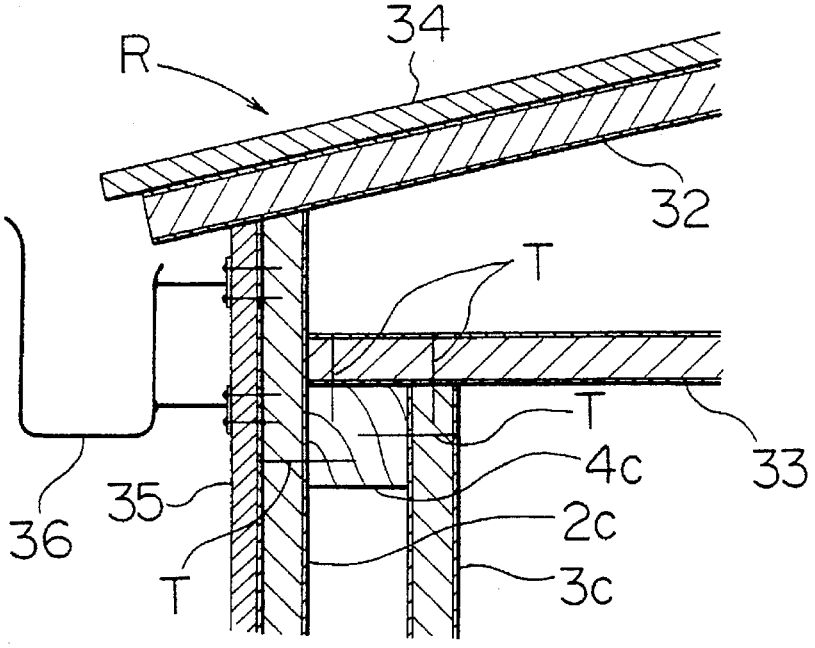
FIG. 4 is a sectional front view showing a part of the roof of the construction.

FIG. 4 shows a roof R. Both a roof boarding 32 of the roof R and a ceiling board 33 of a second floor can be made of lumber core plywood B, as stated above. A waterproof roof cover 34 is installed on top of the roof boarding 32. A rain gutter 36 is installed on top of the external wall. In several of the drawings, a waterproof cladding panel 35 is shown for covering the composite board 2a . . . , which forms the external wall of the house A.

Figure 10:
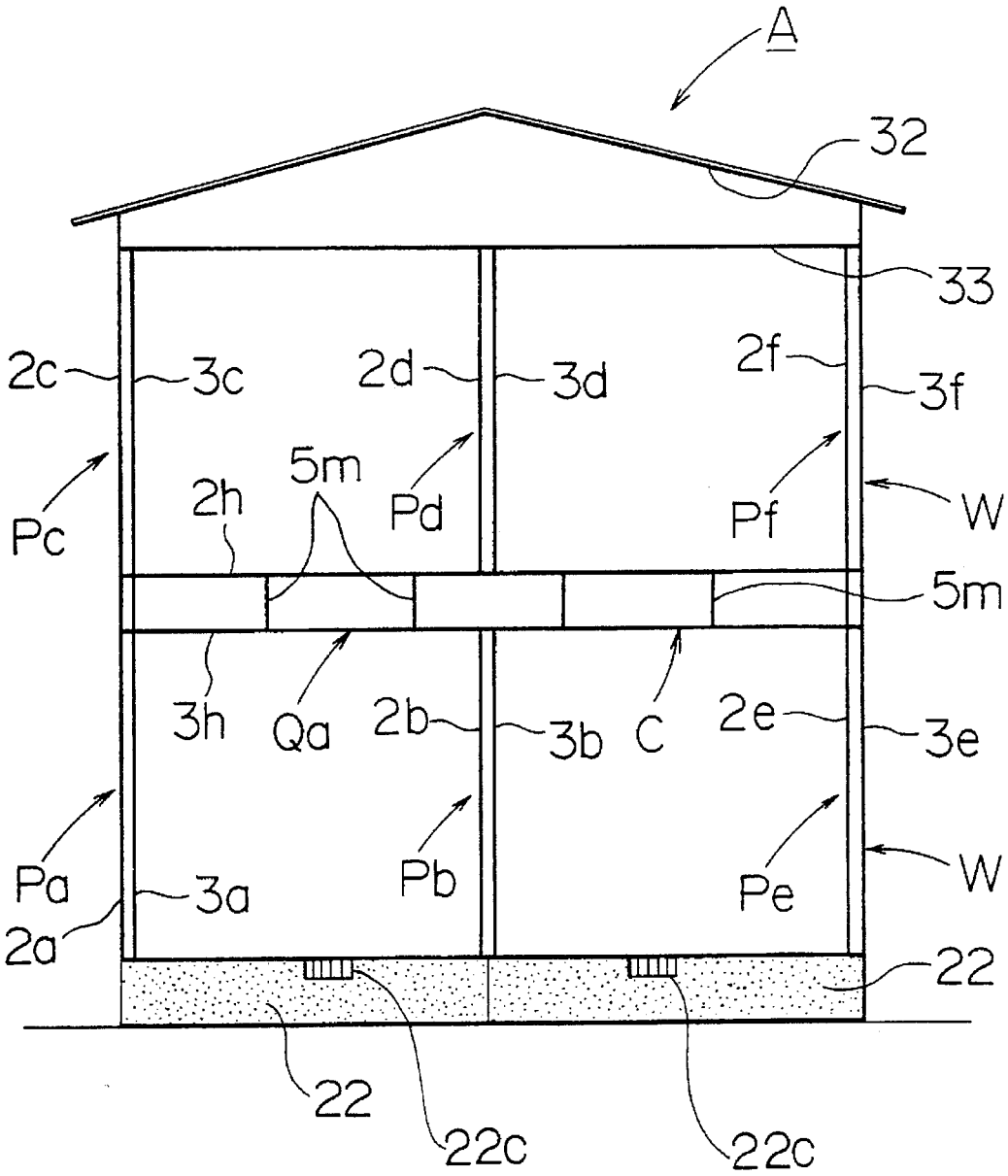
FIG. 10 is a cross-sectional view of the construction, showing the location of installation for the composite boards.

FIG. 10 shows the location of the installation of the composite board, such as 2a . . . and 3a . . . , for the two-floor house A. FIG. 10 also shows composite boards 2d, 2e, 2f, 3d, 3e, and 3f as well as composite assemblies Pd, Pe, and Pf.

Having described this invention as related to the preferred embodiment shown in the accompanying drawings, this invention is not limited to the specific embodiments thereof. For an example while a composite board described above is lumber core plywood it may be any other building board such as chipboard made by bonding wood chip with adhesives. Also, while a composite assembly has been described and shown for use both in the wall and ceiling for separating upper and lower floors, the composite assembly may be used either in the wall or the ceiling for separating upper and lower floor. Further, while the preferred embodiment refers to building a house, this invention may apply to the building of any other type of construction. In the continuous footing of the preferred method the support has been made of a rectangular steel pipe. This could be of any other metallic rectangular pipe or non-metallic rectangular pipe. While the support described above allows expansion and contraction it may be an integral component and may have any shape other than rectangular pipe. The foundation plane of the preferred method is of concrete. It may be of mortar or any other similar material. The foundation plane may cover either the entire area of the construction which it carries or part of the area. While the cladding panel described above is a precast concrete panel it may be any other prefabricated cladding panels such as metallic and synthetic resin panels. It is understood that various changes in the details of building, including their arrangement, form, material and quantity used, may be resorted to without departing the spirit and scope of this invention.

I claim:

1. A method for constructing a building comprising the following steps:

forming a foundation on a ground surface, said foundation having predetermined dimensions forming an outer peripheral surface;

positioning a plurality of upright supports to project upwardly from said foundation, said upright supports including a first end and a distal end, anchor plates being disposed at said first end thereof for securing to said foundation and retainers being disposed at said distal end thereof;

securing cladding panels to said upright supports to extend upwardly from said foundation, said cladding panels providing a substantially continuous footing around the outer peripheral surface of said foundation;

positioning a plurality of preformed composite assemblies on said retainers formed on said upright supports, said preformed composite assemblies each including a pair of composite boards of a prescribed thickness being spaced apart by a predetermined dimension by spacers disposed therebetween; and forming a building by utilizing said plurality of preformed composite assemblies disposed adjacent to each other for forming the walls, the floor and the ceiling of the building.

2. The method for constructing a building according to claim 1, wherein said composite board includes a lumber core plywood.

3. The method for constructing a building according to claim 1, wherein said composite board is a building board constructed of bonded wood chips with adhesive.

4. The method for constructing a building according to claim 1, wherein said composite board is approximately 20 to 40 mm in thickness.

5. The method for constructing a building according to claim 1, wherein said spacers used in said composite boards are square in cross-section.

6. The method for constructing a building according to claim 1, wherein said spacers used in the ceiling are strips of composite boards cut to a prescribed width.

7. The method for constructing a building according to claim 1, wherein said upright supports include first and second members adjustably disposed relative to each other for extension or contraction to adjust the height of the upright supports, said first and second members being affixed relative to each other after adjustment.

8. The method for constructing a building according to claim 1, wherein said upright supports are constructed from rectangular metallic pipe.

9. The method for constructing a building according to claim 1, wherein said cladding panel is a concrete panel.

* * * * *